United States Patent [19]

Baum

[11] 3,941,582

[45] Mar. 2, 1976

[54] DIRECT REDUCED IRON

[76] Inventor: Jesse J. Baum, 10419 Kelso Drive, Sun City, Ariz. 85351

[22] Filed: June 15, 1973

[21] Appl. No.: 370,503

Related U.S. Application Data

[60] Continuation-in-part of Ser. No. 841,181, June 12, 1969, which is a division of Ser. No. 591,997, Nov. 4, 1966.

[52] U.S. Cl. ..... 75/4

[51] Int. Cl.[2] ..... C22B 1/245

[58] Field of Search ..... 75/4

[56] References Cited

UNITED STATES PATENTS

| | | | |
|---|---|---|---|
| 1,193,680 | 8/1916 | Fulton | 75/4 X |
| 1,467,797 | 9/1923 | Klugh | 75/4 |
| 2,863,758 | 12/1958 | Crane et al. | 75/4 |
| 3,264,091 | 8/1966 | Ban | 75/4 X |

FOREIGN PATENTS OR APPLICATIONS

| | | |
|---|---|---|
| 582,056 | 8/1959 | Canada |

*Primary Examiner*—Allen B. Curtis
*Attorney, Agent, or Firm*—John J. Byrne; Edward E. Dyson

[57] ABSTRACT

A process is described for forming highly dense, metal briquettes of reduced size which are suitable for direct melting in an electric induction furnace. A finely divided metal ore concentrate is intermixed with a finely divided carbonaceous reductant thermosetting binder having a low volatile content consisting essentially of 1 to 20% of either coal tar pitch or gilsonite. The intermixture is then compressed to form compressed, compact briquettes ranging in size from two or more inches in diameter to two or more inches in height. The compact briquettes are then heated in a first step at a temperature ranging from approximately 350° to 550°F. in order to caramelize the reductant binder to form tough, handleable, hard briquettes. The briquettes are then further heated in a second step to a temperature ranging from 1,900° to approximately 2,200°F. in a substantially non-oxidizing atmosphere to permit approximately more than 90% reduction of the ore by the binder in the formation of a shrunken, highly dense, metal mass. This process is especially useful in underdeveloped countries because the resulting briquettes may be directly melted into iron in an electric induction furnace.

9 Claims, No Drawings

DIRECT REDUCED IRON

CROSS-REFERENCE TO RELATED APPLICATIONS

This is a continuation-in-part application of my copending application Ser. No. 841,181, filed June 12, 1969, entitled DIRECT REDUCED IRON. Application Ser. No. 841,181 is a divisional application of Ser. No. 591,997, filed Nov. 4, 1966. Application Ser. No. 591,997 is based upon my Philippine Application Ser. No. 7330, filed May 16, 1966, for which priority is claimed under 35 U.S.C. 119.

BACKGROUND OF THE INVENTION

This invention relates to a method for preparing briquettes of iron ore and other oxide ores, the direct reduction of iron ore and other oxide ores. More particularly, this invention relates to a method for producing iron by direct reduction of oxides of iron ores such as $Fe_2O_3$ (Hematite), $Fe_3O_4$ (Magnetite), and FeO such as mill scale, and oxide ores of chromium, manganese, and copper. Specifically, this invention also relates to a novel method for preparing briquettes of such oxide ores, which briquettes may be subsequently reduced in a continuous process with the manufacture thereof or may be sold as articles of commerce.

Generally, the technology of the invention described herein is related to methods for producing a light, porous iron commonly known as "sponge iron;" however, as will appear hereinafter, this invention contemplates a highly reduced, shrunken metal product which has very significant and unexpected characteristics which distinguish the product and the process from conventional sponge iron production.

PRIOR ART

In general, prior art sponge iron processes produce a product which is light in weight and porous, hence the name sponge iron. Sponge iron is quite frequently used to feed melting or casting furnaces; but when such light porous iron is fed into a puddle of molten iron it tends to float on top of the iron and is, therefore, not easily melted into the liquid body. Often, this presents serious handling and feeding problems. Other problems are also present. Since the sponge iron is commonly in the form of highly porous chunks or small particles of iron, there is an exceedingly high surface area which, upon storage, exposure to moisture, and ordinary handling, tends to oxidize. It was proposed in U.S. Pat. No. 1,771,971, issued July 29, 1930, to W. E. Trent, to pass the freshly reduced iron through an oil bath which may perform as a binder for the reduced iron and to reduce oxidation during handling and storage. This procedure partially obviates the problem concerned with oxidation of the reduced iron but does not alleviate the handling problems concerned with the porosity and lightness of the product, and in addition, introduces an additional foreign component which must be reckoned with in future handling of the iron product.

In addition to the above-named methods for producing sponge iron by reaction of iron ore with gaseous reducing agents, it is known to mix oxide ores with solid carbonaceous materials such as charcoal, coke and the like and to heat this intermixture of iron ore and solid reducing agents to produce sponge iron. Sponge iron produced in this manner is similar to sponge iron produced by direct gaseous reduction with regard to the porosity and low density. Such low density porous sponge iron has been produced from briquettes formed of an intermixture of iron ore and charcoal, coke or coal with air slacked lime and water in which a certain amount of water is tenaciously held, presumably in combination with the slacked lime, and where the combined water is slowly evolved during the reduction period. This process, which is described in U.S. Pat. No. 2,028,105, issued Jan. 14, 1946 to Casimir J. Head, is particularly adapted for fixing sulfur which may be present in ores, but the resulting iron sponge product, which may be transferred from the reducing chamber directly into an electric melting chamber containing a bath of molten metal, has the usual disadvantages with respect to physical characteristics and difficulties in handling.

Oxide ores, such as magnetite, may also be intermixed with a solid carbon or carbonaceous material such as charcoal to prevent sintering of the reduced metal during direct reduction by a gaseous reduction agent. In this process, the charcoal does not appear to be consumed to a substantial extent and by discharging the reduced material into water the charcoal floats and can be removed. A process of this type is disclosed in U.S. Pat. No. 2,508,515.

The direct reduction of oxide ores, such as iron oxide to produce conventional sponge iron, by reaction of the iron oxide with powdered carbonaceous material is also known. Such reduction processes are conventionally carried out in closed containers such as saggers. In addition to the problems discussed hereinbefore, there is a substantial problem in such processes regarding means for distributing heat throughout the entire mass of ore concentrate and carbonaceous material. One such process and a proposed solution to the aforementioned problem is given in U.S. Pat. No. 2,587,113, issued Feb. 26, 1952, to Patrick E. Cavanagh. The sponge iron produced by this process is subject to the problems and disadvantages generally related to sponge iron as discussed hereinbefore. A solution to this problem, which is associated with the low density and high porosity characteristics of sponge iron, is suggested in U.S. Pat. No. 2,711,952, issued June 28, 1955, to Howard F. West et al wherein it is proposed to form a relatively dense brick by intermixing with the iron ore and coke, a solution of iron sulphate, for example, spent pickle liquor. These dense bricks are then stacked in a reducing furnace exactly as firebrick are stacked, being spaced to facilitate penetration of heat to the interior of the stack. A muffle type or open burner kiln was then used to produce a reducing atmosphere and to reduce the bricks.

Heating by combustion reaction, such as gas and air, liquid carbonaceous fuel and air, and equivalent methods of heating are often not well suited to particular processes because of the difficulty in controlling the atmosphere. It is known to use electric resistance heat for melting furnaces and the like. It is also known to use electric induction heating to carry out certain reductions processes. A combination reduction furnace and melting furnace in which induction heating is utilized is disclosed in U.S. Pat. No. 2,266,002, issued Dec. 16, 1941, to W. G. Clark. Other induction heating furnaces are disclosed in the above-mentioned patents to W. G. Clark. Generally speaking, such induction furnaces have been used in the prior art and have been subject to most of the problems and difficulities inherent in the production of the sponge iron by processes of the prior art. For example, sintering of the reduced iron to the furnace tube, expansion of the solid mass, the buildup of carbonaceous material in the solid mass, and the physical properties of the end product are present in products by induction heated furnaces in the prior art.

Briquetting of ore or ore intermixtures is known in the prior art but such briquettes as have been made simply by intermixing ore concentrates and finely divided carbonaceous material have produced conventional low density high porosity sponge iron with all its attendant disadvantages. Ban U.S. Pat. No. 3,264,091 discloses such a process based on the direct reduction of small pellets (⅜ to 1½inch diameter). These pellets are then reduced 60 to 90% in a reduction process. The Ban process also uses 30% or more of powdered, non-coking coal and an 11% limestone mix. Such pellets or briquettes, however, have not successfully been used in conjunction with induction heated furnaces. It is fairly common in the prior art, to form briquettes of reduced sponge iron by intermixing fluxing agents, carbonblack, petroleum pitch, and the like and feeding the resulting briquette, sometimes after coking, into an electric smelting furnace or an equivalent furnace to produce molten iron. Such process is disclosed in U.S. Pat. No. 3,072,474, issued Jan. 8, 1963, to R. G. Atkinson et al. A process for producing agglomerated ore for blast furnace use is disclosed in U.S. Pat. No. 3,212,877, issued Oct. 19, 1965, to Roger L. Rueckl; but heretofore briquettes of this general description have not been successfully used to produce directly reduced iron, that is, for producing metallic iron without the necessity of melting the iron with the attendant handling and equipment problems and processes associated therewith.

SUMMARY OF THE INVENTION

The present invention relates to a method for mixing finely divided iron ore (or other ores) with finely divided reductant materials such as powdered coal tar pitch, solid asphalt, liquid asphalt, tar, molasses and similar compounds and then compacting such mixtures into dense briquettes after which the briquettes are heated to a comparatively low temperature of about 525°F., for caramelizing or hardening after which the briquettes are processed into direct reduced iron by passing them through a direct reduction furnace where they are heated for approximately 15 minutes to 2 hours at 1,900° to 2,200°F. in the absence of air or of oxygen.

One object of this invention is to change or convert briquetted iron ore (or other metal oxides) directly to the metal without causing the ore to go through the molten phase. The present invention or discovery requires less heat energy and permits a faster and more complete reduction than other methods of mixing ore with reductants.

Another object of the present invention is to accomplish the reduction of ore with a minimum of capital investment and lower processing costs which results from the method of mixing which is simpler, and requires lower priced equipment and less complicated controls then the usual method of mixng such as the rotating drums or rotating saucers which are used to produce pellets of the type used to charge modern blast furnaces. This invention is specifically adaptable for underdeveloped and emerging nations.

An additional, and extremely important, object of the invention is a process or method to combine any type of finely divided iron ore (or other metal ores) with a combination of binder reductants such as coal tar pitch which is thermosetting or any other material such as tar or asphalt which has similar properties.

A further object of the invention is the provision of a method for producing a hard, handleable, shrunken briquette which is relatively nonporous and in which the highly reduced iron particles are coagulated or welded together into one dense coherent mass suitable for melting in an electric induction furnace.

These and other objects of the invention will become more apparent to those skilled in the art by reference to the following detailed description.

DETAILED DESCRIPTION

Generally, this invention consists of taking a finely divided ore and mixing it with a finely divided reductant binder, preferably powdered coal tar pitch. The mixing takes place in the dry state, using an ordinary paddle or concrete batch type mixer whereby the mixing machine, by rotation or by mechanical agitation, obtains a thorough, intimate and uniform mixture throughout. The combined materials are then pressed into briquettes on an ordinary molding or briquetting machine. At this stage, the green briquettes must be handled with care. They are put through a warm oven of about 525°F. where the pitch is caramelized (hardened) and the briquette becomes hard and tough and may safely be handled by conventional means. The briquette is then dipped or immersed in liquid asphalt, or otherwise coated with liquid asphalt, and, as it is extracted from the asphalt, powdered coal or coke is dusted onto the sticky asphalt in a manner similar to stuccoing of a finely divided hard material on a fresh plaster wall. This product is then ready to charge into a direct reduction furnace so that the ore may be converted directly, without melting, into metals such as iron, copper, chromium, manganese or other metals.

In carrying out the process, the fine ore is mixed with a finely divided reductant such as coal tar pitch. When finely divided iron ore, for example 325 mesh, is mixed with finely divided coal tar pitch of about the same mesh, using about 5 to 15 per cent pitch, and the balance, the finely divided and concentrated iron ore (by weight) and the mixture is formed by pressure into briquettes of two inches or more in diameter by two inches or more in height and the briquettes are heated to 525°F. to thermoset or caramelize the pitch. The briquettes are then hard and tough and may be handled without breaking.

When these hard, tough briquettes are heated in a highly reducing atmosphere to approximately 1,900° to 2,200°F. the oxygen is removed by the pitch, which is a combination reductant binder, and an iron briquette in shrunken form consisting of solid metal iron with a slight amount of gangue material, such as silica and alumina, is produced. Quite unexpectedly, this shrunken briquette is different from the usual sponge iron in that it is relatively non-porous. As the oxygen was removed, the remaining reduced iron particles are coagulated or welded together into one dense, coherent mass. This is distinctly more valuable and useful than the usual porous, low density form of sponge iron. It has none of the characteristics of ordinary sponge iron because it is highly dense. Thus, it will not soak up water, is not easily oxidized, and when fed into a molten bath it sinks and is melted whereas the usual low density sponge iron or reduced iron pellets lie on the surface of a molten bath of iron or steel.

In its most comprehensive form, the process of this invention contemplates the machining or hot forming by forging, of the solid, dense, shrunken metal briquettes into useful articles. such as nuts and bolts.

While coal tar pitch is a highly preferred material, other materials may be used instead of pitch, for example, asphalt, molasses, and tar. A combination of pitch with these materials may be used, such as 5 per cent powdered pitch, 5 per cent liquid or powdered asphalt, 5 per cent fine coal, and 5 to 10 per cent coke.

Other binder materials used to make pelletized iron ore are usually clays, such as bentonite, or water glass. These are expensive and are ultimately wasted since they have no reducing power. On the other hand, my invention provides for materials like coal tar pitch which serve both as binder and as reductant and thus have dual or double function and avoid the waste inherent in the use of bentonite and similar non-reductive binders. In addition, these non-reductive binders increase the non-metallic gangue content.

The following are some examples of different methods of making briquettes according to my invention:

EXAMPLE I

A steel die cylinder 2 inches in diameter by 4 inches long was filled with a mixture containing 84% fine iron ore concentrate, 6% fine powdered coal tar pitch and 10% fine coke by weight. A two pound weight was dropped vertically onto the unpacked ore until the mixture was compressed from 4 inches to 2 inches long. At this point, the hardness according to the AFS (American Foundrymens Association Standards) hardness scale was approximately 90.

EXAMPLE II

A steel die cylinder was filled with ore, pitch, and fine carbon mix as in Example I above. The die was placed under a hydrualic ram or piston and compressed at 3,000 p.s.i. Additional mixture was added and repressing continued until the pressed briquette was 6 inches long. The final briquette was 8 inches in diameter by 6 inches long and included a ½ inch diameter hole through the center, axially.

EXAMPLE III

The ore-pitch-carbon mixture of Examples I and II was placed inside a steel die with an inside diameter of 10 inches and a length of 8 inches. A 500 ton hydraulic press was used to compress the briquette and between pressings the die was refilled until the final briquette was 8 inches long. The total pressure per square inch was approximately 6.4 tons. The final dimensions of the briquette formed was 10 inches in diameter by 8 inches in length.

In Examples I, II, and III, the most generally used mixture of ingredients was 84% ore, 6% pitch, and 10% carbon; however, in each case this mixture was varied for purposes of testing and briquettes were made in each example with a range of from 1 to 15% pitch. Typically, coal tar pitch contains about 94% carbon, 4% hydrogen, and 2% miscellaneous materials.

The thus-formed briquettes formed from Examples I, II, and III were then caramelized in a first heating step at a temperature of approximately 350°F. After curing at this temperature for about 1 hour the briquettes were hard, tough, and handleable.

The briquettes of Examples I, II, and III were then heated in a second heating step to approximately 2,100°F. in a non-oxidizing atmosphere. The reduction time was varied from between 3 to 7 hours. The exact percentage reduction that takes place during the heating steps in Examples I, II, and III was found to be 94%. In other words, 94% of the oxygen was removed from the iron oxide. In the second heating step the size of the briquette was reduced by one-half in volume from that which it began with. Not only were the briquettes reduced 50% in volume but the weights were reduced by 34% from their original weight.

Microphotographs were taken of the shrunken briquettes after reduction to confirm chemical analysis. The basis chemical reaction that occurred during reduction is:

$Fe_3O_4 + 3C + H_2 = 3Fe + 3CO + H_2O$ The oxygen is removed as carbon monoxide gas and the iron remains as a solid, shrunken mass of FE and FEO which melts readily in an arc or an induction melting furnace.

Some outstanding points of my invention are as follows:

1. By mixing a material, such as "hard grade" coal tar pitch, which has the properties of being both a thermosetting plastic binder and a reductant with fine magnetite iron ore, it is possible to obtain an intimate mixture reductant with the ore. The speed of a chemical reaction is approximately proportional to the surface area of contact between the reagents, in this case the reductant pitch and the oxide iron ore, and by mixing fine ore with a fine binder reductant, it is possible to obtain, first, a strong briquette and, secondly, a close surface contact over a greatly increased area. Thus at a proper temperature range and the proper time in the correct atmosphere the reduction reaction proceeds rapidly and uniformly over the cross-section of the very dense iron briquette.

2. The mixing of the dried powders and fine ores in liquids such as asphalt can be effected at low cost with simple, commercially available, mixing equipment. The subsequent briquetting is also carried out with conventional equipment and is a low cost operation.

3. The product obtained after reducing such a briquette is a dense chunk or shrunken briquette of iron which is different from the usual sponge iron. The direct reduced briquette is dense and relatively waterproof. It will sink into a molten metal bath when used as synthetic iron or steel scrap and will not soak up water and reoxidize. This characteristic is distinctly different from the property exhibited by sponge iron as it has been known herebefore. When iron ore is directly reduced from "pellets" or natural lump ore, which has been crushed to a small size, for example, two inches or less in diameter, it has a low degree of density because it is full of cavities where the oxygen has "exited" from sponge iron pellets and after direct reduction, it remains porous and lightweight. This form of iron cannot be used in steel melting furnaces directly to make iron or steel with the same advantages that are possessed by the directly reduced briquettes of the present invention because they are too light and tend to float on top of the molten metal bath. The low density directly reduced iron is oftentimes reground and briquetted as described in the prior art, in order to increase the density. By the present method, this operation is unnecessary.

4. There are three main forms of directly reduced iron known in the prior art, which include: pellets reduced or unreduced which are used primarily in blast furnaces; lump ore directly reduced to a porous lump; and fine ore reduced and then sintered to coagulate into sinter cake. In all these cases the product is not entirely satisfactory and the cost of production is often prohibitively high. In the present invention, the product is low cost and meets the requirements of the trade more satisfactorily than does the forms mentioned because the product of the present process is much more dense and does not have to be briquetted after reduction.

5. Most of the iron ores available in the world today are "lean" or "low grade" ores. As a result, they must be ground finely to separate the undesired elements, such as pyrites (FeS), silica and alumina by magnetic and other means. These fine mesh concentrates cannot be used in their fine powdered form. They must be reformed into pellets or sintered at high temperature to sinter cake before charging into a blast furnace to avoid the powder being blown out the top of the stack. In the present process, there is no such problem. The original briquette remains in the same shape, although it has shrunken to about one--half its original size. This shrinkage is caused by the small particles of reduced iron welding together and contracting inwardly as the oxygen and other products such as moisture, carbon and hydrogen and the oxide reactant gases move out of the briquette. A dense, almost solid metal chunk or solid briquette is the result. Thus the product can be charged as synthetic cast iron or steel scrap, depending on the carbon content, directly into cupolas, open hearth, electric arc, induction, basic oxygen, carbo-electric furnaces and even blast furnaces to make iron and steel.

The hardened, caramelized, briquettes of the process may be used in other types of furnaces as well, For example, the pitch bonded briquettes of this invention, which contain from 1 to 20 percent by weight of pitch, and preferably from 8 to 10 per cent pitch, may be used with other direct reduction processes such as the Hoeganes type process at Riverton, New Jersey and Hoeganes in Sweden where sealed saggers or containers are filled with coal and crushed lumps of iron ore and then processed through a heat cycle of about 2 to 3 days where the maximum heat range is from 1,900°to 2,100°F.

These briquettes may also be used in the HyL process at Monterey, Mexico where reducing gas is passed through the lump or pellet ore which is placed in the reducing vessel excluding outside air and in the Echeverria process where crushed ore is used in a process similar to that described hereinbefore except that producer gas is used for a heat source instead of inductive electric power. When used in these processes, in place of the usual charge, the pitch bonded briquettes very effectively produce a superior product. Indeed, while this instant process gives best results, the pitch bonded briquettes of this invention will produce a superior product when used with any successful direct reduction process.

Another advantage of the present invention is that various alloy compositions may be made by mixing various metals, alloys or metallic ore powders. Thus, the invention is not limited to iron briquettes. For instance, manganese steel briquettes may be produced by mixing manganese ore and iron ore in the desired proportions and reducing the pitch bonded briquettes formed of the intermixture. In the same manner, chrome ore or ferro-chrome powder can be mixed with iron ore and pitch to make chromium containing chrome steel with a desired percentage of chrome in the alloy. If nickel oxide or nickel is added to the mixture, a stainless steel master alloy of any desired composition may be produced by direct reduction. Thus, synthetic master alloys can be made which may be then sold for remelting to produce specific alloys of any desired grade. A similar end result is obtained by sintering metallic powders; however, the present invention permits the use of ores directly to produce synthetic master alloys. For example, a high carbon iron, containing about three per cent carbon, may be used in place of cast iron scrap and lower carbon iron, for example less than one per cent carbon, may take the place of steel scrap. Ores of iron, chromium, nickel, copper, manganese, tungsten, vanadium, and molybdenum may be intermixed to produce a definite master alloy.

In order to obtain best results, the moisture content of the mixture should carefully be controlled. For example, the moisture content of an intermixture of powdered iron ore and pitch should range from 5 to 7 per cent by weight of the pitch ore mixture. The method of mixing comprises the following steps: first, the moisture in the fine mesh ore is reduced by drying to less than one and one-half per cent so that the mixture is essentially dry. In this dry state it will readily mix with the powdered pitch. Second, the ore and dry pitch are mixed in any common mixing machine to get a uniform intimate mixture. For example, a sand muller or paddle type mixer may be used.

Third, after an intimate dry mixture is obtained, water is added so that the total water content is approximately 6 per cent by weight. Mixing is continued for about three minutes until the water is completely and uniformly dispersed. The mixture is now ready for briquetting.

After the mixture is briquetted, it is heated to 525°F., approximately for about one-half hour, to strengthen it and harden it so that the briquette will not fracture during reduction. The reason that the moisture is important is because it assists the pitch to "smear onto" or to "wet" the surface of the ore particles. Thus, a strong "green" bond is established between the pitch and the ore making the briquette easy to handle without breaking. In the subsequent baking operation the moisture is, of course, removed. The use of moisture, as described, results in a very hard and tough briquette after the baking operation, and this is essential to prevent deterioration of the briquette while passing downwardly through the reduction stack.

A pitch of the type which has been found satisfactory was obtained from the J. S. McCormick Co. of Pittsburgh, Pa., and has an approximate analysis as follows:

| | | |
|---|---|---|
| Melting point | — | 300 to 320°F |
| Carbon | — | 93.7% |
| Sulfur | — | 0.5% |
| Hydrogen | — | 4.1% |
| Nitrogen | — | 1% |
| Oxygen | — | 0.6% |
| Ash | — | 0.1% |

Iron ore concentrates with at least 50 per cent iron, and preferably from 60 to 69 per cent iron, are most advantageously used in the present process. Briquettes composed of such iron ore and pitch bonded in the manner described in the process, do not tend to sinter or hang up in the furnace as has been a problem heretofore. There is no problem at all with bridging in the furnace with the briquettes of this process, especially briquettes which have been dipped in asphalt and stuccoed with powdered coal or coke. These desirable results occur in part from shrinkage of the briquettes during reduction.

Another feature of this invention is the convenience by which the briquettes may be made. It is known in the prior art to make briquettes, but extremely high pressures are frequently required. Ordinary briquetting equipment may be used in the present process and low pressures, on the order of about 3000 pounds per square inch, are sufficient to form the instant briquettes.

A summarized version of the present process is given below wherein the steps are, generally, in the sequence in which performed:

1. Metal or concentrates in finely divided form are provided. The metal concentrates are preferably selected from a group consisting of iron, copper, manganese and chromium, although these ore concentrates may be intermixed with minor proportions of other ores such as oxides of tungsten, nickel and the like to provide a desired master alloy.

2. At least one of the ore concentrates, and possibly two or more, is intimately mixed with a finely divided thermo-setting reductant binder. Coal tar pitch gives unexpectedly good results as such a binder. As stated previously, this intermixture is preferably accomplished in the dry form followed by the addition of water, which may comprise a separate step.

3. The intermixture of ore concentrate and reductant binder, preferably a coal tar pitch in the range of from 1 to 20 percent by weight and, in a highly preferred embodiment, from 8 to 10 per cent by weight, is pressed into a desired briquette form.

4. The briquettes are then heated to a temperature sufficient to drive off moisture and volatile material and to caramelize the reductant binder to form a rough, hard thermo-set briquette of sufficient strength to be handled by conventional means. This temperature is in the range of 350°F. to 550°F. and preferably about 525°F. In a preferred embodiment of the process, this preheating caramelizing step is accomplished by the utilization of waste heat from a furnace.

5. In the embodiment of the process, a layer of molten carbonaceous resinous material, such as molten asphalt, is provided on the outer surface of the briquette by dipping the briquette therein or by other means.

6. Next, a discontinuous layer of powdered carbonaceous material such as powdered coal or coke is provided on the outer surface of the coated briquette.

7. The briquette is then heated in the absence of oxygen to a temperature sufficiently high to cause the caramelized reductant binder to react with the ore concentrate to reduce substantially all of the ore to free metal in finely divided form and to weld the free metal particles into a briquette of substantially diminished size which has a very low porosity and a high density. This heating step may be accomplished by encircling the reduction zone with a ferro-magnetic susceptor material and inductively producing current flow in the susceptor material to resistively heat the susceptor material.

8. The high density reduced briquette may then be cooled and formed into a useful metal article by mechanically removing portions of the reduced high density briquette or by forging the same.

Alternatively, the high density reduced briquette may be directly melted to conserve its residual heat in a furnace of a type described hereinbefore. If the reduced briquette is cooled and recovered in its solid form, it may be stored or sold as an article of commerce. The characteristics of this briquette may be described in general terms. The relative density with respect to sponge iron and the relative porosity make it distinctly different from sponge iron and make it also different from cast metal. Because of its economy, it is a convenient source of synthetic scrap, and may be used to form useful articles, for example, nuts and bolts. While these articles have the same general utility as nuts and bolts formed from cast metals, the composition is different as the result of the production process involved.

As discussed previously, control of the reduction process in the furnace and in the production of auxiliary heat to preheat the briquettes may be accomplished by the injection of reducing and oxidizing materials respectively into the furnace.

While the process has been described as a continuous series of steps, it will be realized that the caramelized or hardened briquettes may also be stored, handled, and sold as articles of commerce.

In a general manner, while there have been disclosed effective and efficient embodiments of the invention, it should be well understood that the invention is not limited to such embodiments, as there might be changes made in the arrangement, disposition, and form of the parts without departing from the principle of the present invention as comprehended within the scope of the accompanying claims.

I Claim:

1. A process for forming high density metal briquettes of reduced size comprising the steps of:

intermixing finely divided metal ore concentrate, wherein said metal is selected from the group consisting of iron, copper, manganese, and chromium, with finely divided carbonaceous reductant thermosetting binder having a low volatile content consisting essentially of 1 to 20% of a material taken from the following group: coal tar pitch or gilsonite, compressing the intermixture of the next previous step to form compact briquettes ranging approximately in size from 2 or more inches in diameter by 2 or more inches in height, heating the compact briquettes in a first heating step to a sufficiently high temperature ranging from approximately 350° to approximately 550°F. to caramelize the reductant binder to form handleable, tough, hard briquettes but insufficiently high temperature to initiate chemical reaction between the reductant binder and the metal ore concentrate and to destroy the adhesive properties of the reductant binder, and further heating and shrinking the hard, handleable briquettes formed in the first heating step by subjecting same to a temperature ranging from approximately 1,900°F. to approximately 2200°F. in a substantially non-oxidizing atmosphere to permit approximately more than 90% reduction of the ore by the binder in the formation of a shrunken, highly dense, metal mass.

2. The process of claim 1 wherein:

the intermixture of ore concentrate and reductant binder comprises ore concentrate in the range of 80 to 95% by weight and reductant binder in the range of 5 to 20% by weight.

3. The process of claim 1 wherein the intermixture of ore concentrate and reductant binder comprises reductant binder in the range of 1 to 15% by weight.

4. The process of claim 1 wherein:

the intermixture of ore concentrate and reductant binder comprises reductant binder in the range of 5 to 8% by weight.

5. The process of claim 1 further comprising the step of:

coating the hard briquette with a substantially continuous layer of asphalt.

6. The process of claim 4 further comprising the step of:

coating the hard briquette with a substantially continuous layer of asphalt.

7. The process of claim 5 further comprising the step of:

coating the asphalt-coated, hard briquette with a discontinuous layer of powdered material selected from the group consisting of coal and coke, said discontinuous layer being adhesively adhered to the outer surface of the asphalt coating by the asphalt.

8. The process of claim 6 further comprising the step of:

coating the asphalt coated, hard briquette with a discontinuous layer of powdered material selected from the group consisting of coal and coke, said discontinuous layer being adhesively adhered to the outer surface of the asphalt coating by the asphalt.

9. The process of claim 1 wherein said binder is selected from a group further consisting of: asphalt, tar, and molasses.

* * * * *